United States Patent [19]

Lutz

[11] 4,226,218

[45] Oct. 7, 1980

[54] CARBURETOR IDLE JET CONTROL

[76] Inventor: Russell L. Lutz, R.D. #1, Box 1148, Mohnton, Pa. 19540

[21] Appl. No.: 939,464

[22] Filed: Sep. 5, 1978

[51] Int. Cl.[2] ..... F02D 31/00

[52] U.S. Cl. ..... 123/325

[58] Field of Search ..... 123/97 B, 102

[56] References Cited

U.S. PATENT DOCUMENTS

| | | | |
|---|---|---|---|
| 2,415,336 | 2/1947 | Carlson | 123/97 B |
| 2,617,398 | 11/1952 | Taber | 123/97 B |
| 2,724,375 | 11/1955 | Schaffer | 123/97 B |
| 2,733,696 | 2/1956 | Schneider | 123/97 B |
| 2,749,894 | 6/1956 | Sarti et al. | 123/97 B |
| 2,793,001 | 5/1957 | Gallun | 123/97 B |

*Primary Examiner*—Wendell E. Burns

[57] ABSTRACT

Methods and means are disclosed for controlling the flow of gasoline through the idle jet of the carburetor of an automotive internal combustion engine. To improve mileage, flow through the idle jet is discontinued when the vehicle is traveling above a minimum speed provided that the vacuum in the intake manifold does not fall too low. Additional fuel economy may be obtained by stopping the flow of gasoline through the idle jet at any time the throttle is advanced and fuel flows through the main jets of the carburetor.

In the simplest mechanical embodiment of the invention, the flow of fuel through the idle jet feed line is controlled by an atmospheric vent provided in the idle jet feed line. When the vent is open to atmosphere, the vacuum from the intake manifold is broken and no fuel will be drawn from the carburetor float bowl by the idle jet to the engine. The atmospheric vent is conveniently controlled by the combination of an electrical solenoid that is responsive to intake manifold vacuum and a microswitch that is responsive to throttle advance.

2 Claims, 2 Drawing Figures

CARBURETOR IDLE JET CONTROL

BACKGROUND OF THE INVENTION

1. Field of the Invention

This invention relates to internal combustion engines for automotive vehicles and, more particularly, to methods and means for controlling the flow of fuel through the idle jet of a carburetor. More particularly, this invention is concerned with improving the fuel economy of automotive vehicles by stopping the flow of fuel through the idle jet of the carburetor of an internal combustion engine when idle jet fuel is not required to keep the engine running.

2. Description of the Prior Art

To prevent an internal combustion engine from stalling when the throttle (butterfly valve of the carburetor) is closed, it is conventional to provide an idle jet on the intake manifold side of the butterfly valve to provide fuel to keep the engine idling. It has long been recognized that the idle jet wastes gas since fuel continues to flow through it without regard as to whether fuel is needed to keep the engine idling. A particularly wasteful condition occurs when the vehicle is coasting downhill or into a controlled intersection. Here the operator's foot is off the throttle but, due to the speed of the coasting vehicle and the fact that the butterfly valve is shut, the vacuum within the intake manifold rises toward a maximum and raw fuel is drawn through the idle jet and into the engine at a high rate. Since the vehicle is coasting, no fuel is needed to keep the engine running and the fuel that is fed through the idle jet is totally wasted. This is not only wasteful but is also undesirable since there is not enough combustion air to burn the raw fuel that passes through the idle jet resulting in an engine exhaust high in unburned hydrocarbons and other objectionable emissions.

Prior art devices have proposed solutions to this problem by providing valved means to discontinue the flow of fuel through the idle jet of the carburetor when the vacuum in the intake manifold is high since this is the condition that pertains when the operator's foot is off the throttle when the vehicle is coasting. While these devices are theoretically sound, they generally fail in practice since the engine will stall when the vehicle decelerates to a low speed even though the vacuum is still high. Also these devices variously may be complex and expensive, or not readily useable in modifying existing carburetors.

SUMMARY OF THE INVENTION

Accordingly, it is an object of this invention to provide for better fuel economy and mileage in the operation of an internal combustion engine.

Another object of this invention is to reduce objectionable emissions from the exhaust of internal combustion engines.

Another object of this invention is to provide simple means for discontinuing the flow of fuel through the idle jet of an internal combustion engine when not needed without causing the engine to stall or without requiring special skills or the attention of the operator.

Another object of this invention is to provide a simple means whereby existing carburetors now installed on automotive vehicles may readily be altered to provide for greater fuel economy.

These and other objects of this invention are achieved by stopping the flow of fuel through the idle jet of the carburetor of an internal combustion engine when the engine is running over a predetermined rpm. In a preferred embodiment of the invention, to insure against stalling, the speed control is overridden and the flow of idle fuel is restored if the vacuum in the intake manifold falls too low. To save still additional fuel, the flow of fuel through the idle jet is also interrupted at any time that the throttle is advanced beyond the idle position.

DESCRIPTION OF THE DRAWINGS

The invention can be better understood in connection with the accompanying drawings, in which:

In FIG. 1, there is shown a carburetor 1 having a fuel bowl 3 and a float 5 to control the level of fuel within the bowl 3. Located at the bottom of the fuel bowl 3 is a main jet 7 that is the inlet orifice of the main jet feed line 9. Feed line 9 leads to a vaporizer 11 located within the main venturi 13 of the carburetor throat 15. A butterfly valve 17 (throttle valve) is located between the venturi 13 and the entrance 18 to the engine intake manifold (not shown).

Figure 1:
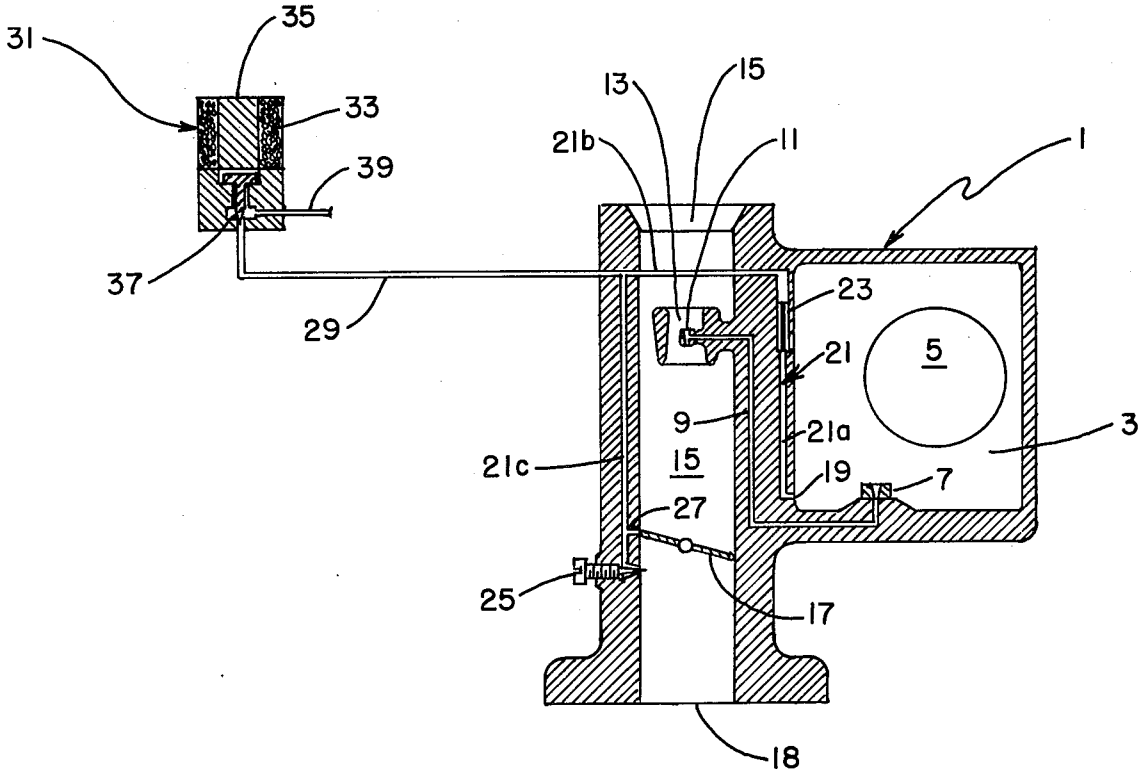
FIG. 1 is a schematic cut-away view of a carburetor associated with a device for controlling the flow through the idle jet of the carburetor.

An idle jet inlet orifice 19 is located adjacent the bottom of the fuel bowl 3 and provides fluid communication to the idle jet feed line 21, illustrated in the drawing as being comprised of an upward leg **21*a*, a horizontal leg 21*b*, and a downward leg 21*c*. An idle jet 23 is positioned within the idle jet feed line to control the gross amount of fuel that may pass through the idle jet feed line 21. An idle adjustment screw 25 is positioned at the discharge orifice of the downward leg 21*c* of the idle jet feed line 21. A regulating port 27 is associated with the downward leg 21*c* of the idle jet feed line 21, the opening of which is controlled by the position of the butterfly valve 17**.

A vacuum bleed line 29 communicates with the idle jet feed line 21 at a point which is not critical but, as illustrated in the drawing, is associated with the horizontal leg **21*b*. The vacuum bleed line 29 is in fluid communication with an atmospheric vent line 39 by way of a stop valve 37. The stop valve 37 is rigidly affixed to armature 35 which is surrounded by an induction coil 33 of a solenoid 31**.

When the engine is in operation, the introduction of air and fuel into the intake manifold is controlled by the position of the butterfly valve 17. Butterfly valve 17 is shown in the drawing in its closed position which blocks the passage of fuel and combustion air through the carburetor throat 15. However, when the throttle valve 17 is rotated away from its closed position, combustion air will flow into the carburetor throat 15 and in and around the main jet venturi 13 aspirating fuel into the intake manifold.

Since the butterfly valve 17 is closed when the throttle is in the idle position, an auxilliary supply of fuel must be provided to keep the engine running. Fuel for this purpose is supplied via the idle jet inlet port 19 and the idle jet feed line 21. The speed at which the engine idles can be controlled by the position of the idle adjustment screw 25.

Figure 2:
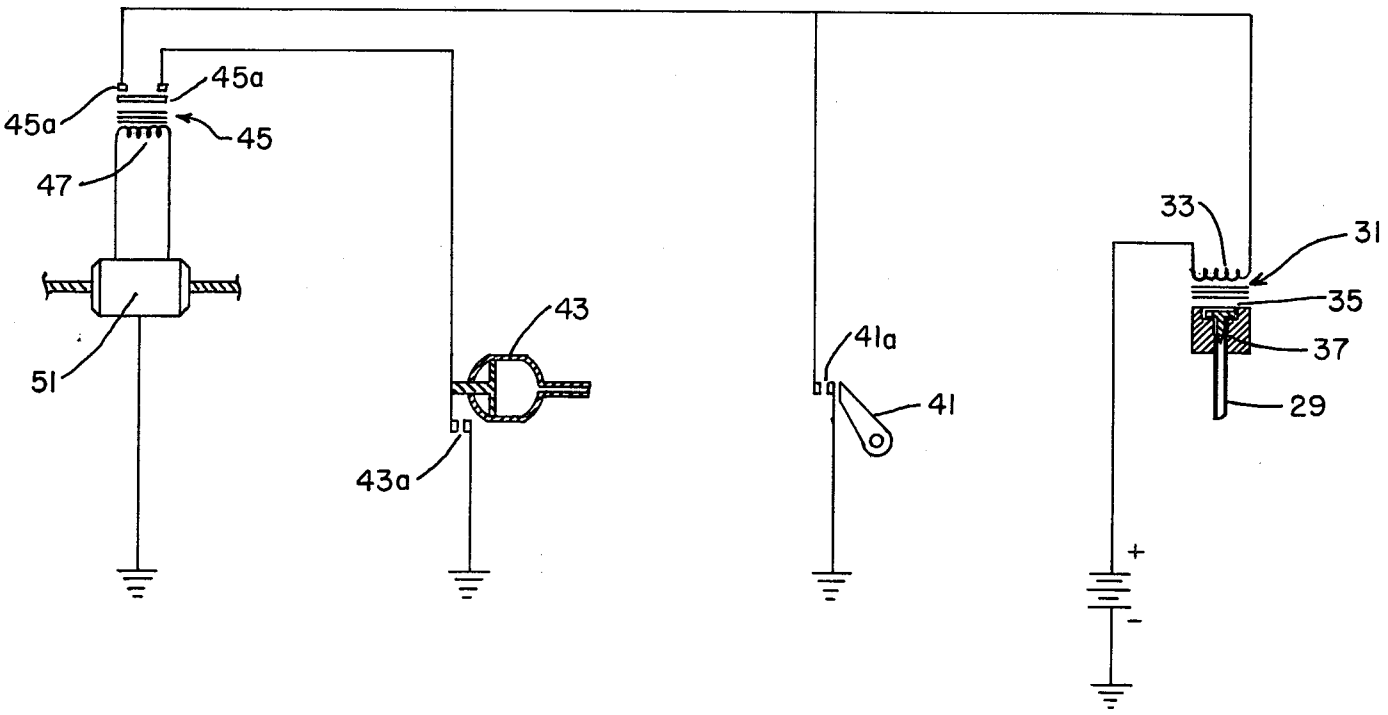
FIG. 2 is a schematic diagram illustrating preferred types of control devices and an electrical hook-up suitable for accomplishing the purposes of this invention.

The operation of the solenoid 31 and its attached stop valve 37 can better be understood with reference to FIG. 2 which schematically illustrates the controls and electrical connections to the solenoid 31.

A throttle switch 41 having a contact 41*a* is wired in series with the coil 33 and is adjusted so that any time the throttle is opened beyond the idle speed, the contact 41*a* will shut, energizing the coil 33 to cause the armature 35 to lift stop valve 37 off of its seat and vent the vacuum bleed line 29 to atmosphere through the atmospheric vent line 39.

Vacuum switch 43 and its associated contact 43*a* is wired in series through generator switch 45 and its associated contact 45*a* with the coil 33 so that when the contact 43*a* of the vacuum switch 43 and the contacts 45*a* of the governor switch 45 are closed, the coil will be energized to lift stop valve 37 off of its seat and vent the vacuum bleed line to atmosphere through the atmospheric vent line 39. The vacuum switch 43 is connected by a line (not shown) to the intake manifold. The vacuum switch 43 may be adapted, depending upon the type of engine, to open, for example, above eleven inches of mercury vacuum and shut below this point. Thus anytime the vacuum falls below a predetermined minimum and the engine is in danger of stalling, the vacuum switch 43 will open contact 43*a* and cause the stop valve 37 to shut under the bias of spring pressure, and the flow of fuel through the idle jet will be restored.

By any convenient means, such as a small generator 51 driven by the speedometer cable, a variable voltage can be developed that will open or close the governor switch depending on the engine speed. With one particular automobile on which the device of this invention has been tested, it has been found useful to set the governor switch to shut at speeds over 10 miles per hour. When the automobile slows to below 10 miles an hour, contact 45*a* will be open, stop valve 37 is seated, the vacuum is restored, and the fuel will be drawn through the idle jet feed line.

It can be seen that throttle switch 41 is separately wired to the solenoid 31 and will energize the solenoid regardless of the position of either the vacuum switch 43 or the governor switch 45. Any time that the throttle is advanced to above idle speed, the solenoid 31 will be energized, the stop valve 37 will be lifted off of its seat against the force of the spring bias, the vacuum bleed line 29 will be vented to atmosphere, and the flow of fuel through the idle jet feed line 21 will be interrupted. The purpose of this is to prevent fuel from being wasted through the idle jet when the engine is receiving a normal supply of fuel from the main jets.

Assuming that the throttle switch 41 is in its open position—that is, the throttle is in the closed position—the vacuum switch 43 and the governor switch 45 take over to control the operation of the solenoid 31. When both of these switches shut, the solenoid is energized and the stop valve 37 is lifted off its seat the flow of fuel through the idle jet feed line 21 is interrupted. If either the vacuum switch 43 or the governor switch 45 are open, however, no current will flow to the solenoid 31 and fuel will flow normally through the idle jet feed line 21.

The engine may be operated without the vacuum switch 43, making use only of the governor switch 45. However, to accommodate certain conditions of operation, such as when the engine is cold or not properly tuned, the governor switch 45 must be set to open at higher speeds than may otherwise be desirable to prevent stalling. But when the vacuum switch 43 is placed in series with the governor switch 45 to prevent the engine from stalling at low intake manifold vacuum, the governor switch 45 can be adjusted to open at a considerably lower vehicle speed than if the vacuum switch is not used. The function of the vacuum switch 43 is, therefore, to permit adjustment of the governor switch 45 to lower levels than otherwise would be practical so that a maximum saving of gas can be achieved.

Thus, from the foregoing description of this invention, it can be understood that its function is to prevent gasoline wasted in the idle jet system of a carburetor when such gasoline is not needed to keep the car running. The times that this invention is of utility are essentially those when a vehicle is coasting or when the butterfly valve is open. Stated differently, the carburetor adjusted in accordance with this invention will draw fuel through idle jet only when the throttle is closed and the vehicle is essentially at rest.

While the invention has been described as a system in which the flow of fuel through the idle jet feed line is interrupted by venting the line to atmospheric pressure, other mechanical embodiments can be used to achieve the same functional result. For example, the idle adjustment screw 25 could be mounted for reciprocating motion and made responsive to a solenoid to open or shut the idle jet feed line discharge orifice. Depending on whether the idle adjustment screw 25 would be biased normally open or normally shut, the throttle, vacuum and governor switches would be connected to energize or de-energize the solenoid as appropriate.

It also should be understood that while the governor switch is illustrated as being an electrical one, it could, in a less preferred embodiment of this invention, be mechanically operated.

It was mentioned above that it was not critical for the vacuum bleed line 29 to communicate with the horizontal leg 21*b* of the idle jet feed line 21 but this is convenient when adapting an existing carburetor to function in accordance with this invention since only a single passageway need be drilled in the carburetor to form a link-up between the bleed line 29 and the feed line 21. Thus it is contemplated that this invention will provide not only a means to conserve gasoline on new automotive vehicles, but also provides a simple and inexpensive method of modifying existing vehicles.

I claim:

1. A method for increasing the efficiency of an automotive internal combustion engine by interrupting the flow of fuel to the idle jet of the carburetor when idle jet fuel is not required to keep the engine running, the improvement comprising an electrically operated valve to control the flow of fuel through the idle jet which is controlled by a first switch wired in series with the valve and a second and a third switch wired in a series with each other and the valve but in parallel to the first switch; the opening and closing of the first switch being controlled by the throttle, the second switch being controlled by the speed of the engine, and the third switch controlled by the vacuum within the intake manifold of the engine.

2. A method in accordance with claim 1 wherein one side of the electrically operated valve is open to the atmosphere and the other side communicates with the idle jet feedline of the carburetor.

* * * * *